US006669069B2

(12) United States Patent
Suggs

(10) Patent No.: US 6,669,069 B2
(45) Date of Patent: Dec. 30, 2003

(54) SHOULDER STRAP ASSEMBLY FOR GOLF BAGS

(75) Inventor: Gregory M. Suggs, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 7 days.

(21) Appl. No.: 10/121,775

(22) Filed: Apr. 11, 2002

(65) Prior Publication Data

US 2003/0192929 A1 Oct. 16, 2003

(51) Int. Cl.[7] ..... A45F 3/04

(52) U.S. Cl. ..... 224/645; 224/264; 224/607; 224/643; 206/315.3

(58) Field of Search ..... 224/643, 644, 224/645, 264, 607; 206/315.3

(56) References Cited

U.S. PATENT DOCUMENTS 4,768,650 A * 9/1988 Chancellor, Jr. ..... 206/315.3
4,834,235 A 5/1989 Solheim et al.
5,038,984 A * 8/1991 Izzo ..... 224/643
5,042,703 A 8/1991 Izzo
5,042,704 A * 8/1991 Izzo ..... 224/643
5,072,867 A * 12/1991 Zingale ..... 224/162
5,954,255 A 9/1999 Beebe et al.
6,467,661 B1 * 10/2002 Mistretta et al. ..... 224/264
6,488,191 B1 * 12/2002 Suggs et al. ..... 224/643
6,550,653 B2 * 4/2003 Matthews ..... 224/250

* cited by examiner

*Primary Examiner*—Jes F. Pascua
(74) *Attorney, Agent, or Firm*—Darrell F. Marquette

(57) ABSTRACT

A golf bag has a generally tubular body and a dual shoulder strap assembly for supporting the golf bag on both shoulders of a golfer. The dual shoulder strap assembly includes first and second shoulder straps, and a lower end of the first shoulder strap is received in and connected to a pocket on the body. An elongated plate is located within the lower end of the first shoulder strap so that an upper portion of the first shoulder strap is formed into a loop that extends generally laterally from the body in a standing position to make it easier for a golfer to identify which shoulder strap should be grasped first when preparing to lift the golf bag and carry it.

15 Claims, 3 Drawing Sheets

SHOULDER STRAP ASSEMBLY FOR GOLF BAGS

BACKGROUND OF THE INVENTION

This invention relates generally to golf bags and, in particular, to a shoulder strap assembly for golf bags.

It is recognized that golf bags usually have either a single shoulder strap for supporting the golf bag on one shoulder or a dual shoulder strap arrangement for supporting the golf bag on both shoulders. Whenever golf bags are provided with a dual shoulder strap arrangement, the golfer must grasp a particular shoulder strap first whenever the golf bag is being lifted into place on his or her shoulders. If the golfer should happen to grasp the wrong shoulder strap first, the golf bag cannot be lifted onto the golfer's shoulders and carried in the manner intended. This presents a problem especially for new users of dual shoulder strap arrangements in that they often grasp the wrong shoulder strap first and then become discouraged enough to revert to carrying the golf bag on only one shoulder thus depriving themselves of the benefits of spreading the load evenly on both shoulders. Even golfers that have been using dual shoulder strap arrangements for some time become frustrated when they inadvertently grasp the wrong shoulder strap.

SUMMARY OF THE INVENTION

The present invention provides a golf bag including a body and a shoulder strap assembly. The body has a generally tubular configuration and a top end, and the shoulder strap assembly includes a first shoulder strap having an upper end attached to the body at a first location proximate the top end thereof and a lower end. Cooperating interconnecting elements formed on the body and on the first shoulder strap attach the lower end of the first shoulder strap to the body at a second location which is spaced from the top end thereof. Stiffener means in the lower end of the first shoulder strap hold an upper portion of the first shoulder strap in a standing position where it extends generally laterally from the body.

The shoulder strap assembly may include a second shoulder strap having an upper end thereof attached to the body at a third location proximate the top end thereof and a lower end attached to the body at a fourth location which is spaced from the top end thereof. The cooperating interconnecting elements may include a pocket formed on the body for receiving the lower end of the first shoulder strap, and attachment means on the body and on the first shoulder strap for holding the lower end of the first shoulder strap in the pocket. The stiffener means may be an elongated plate mounted in the lower end of the first shoulder strap. This plate preferably is longitudinally flexible but laterally rigid so that it will hold a lower portion of the first shoulder strap in a substantially juxtaposed position relative to the body. The upper portion of the first shoulder strap is formed into a loop by the plate and is held by the plate in the standing position so that the first shoulder strap is easily identified. Therefore, a golfer would not need to bend over to grasp the first shoulder strap since the upper portion thereof will extend to a height near the golfer's waist line.

DESCRIPTION OF THE PREFERRED EMBODIMENT

Figure 1:
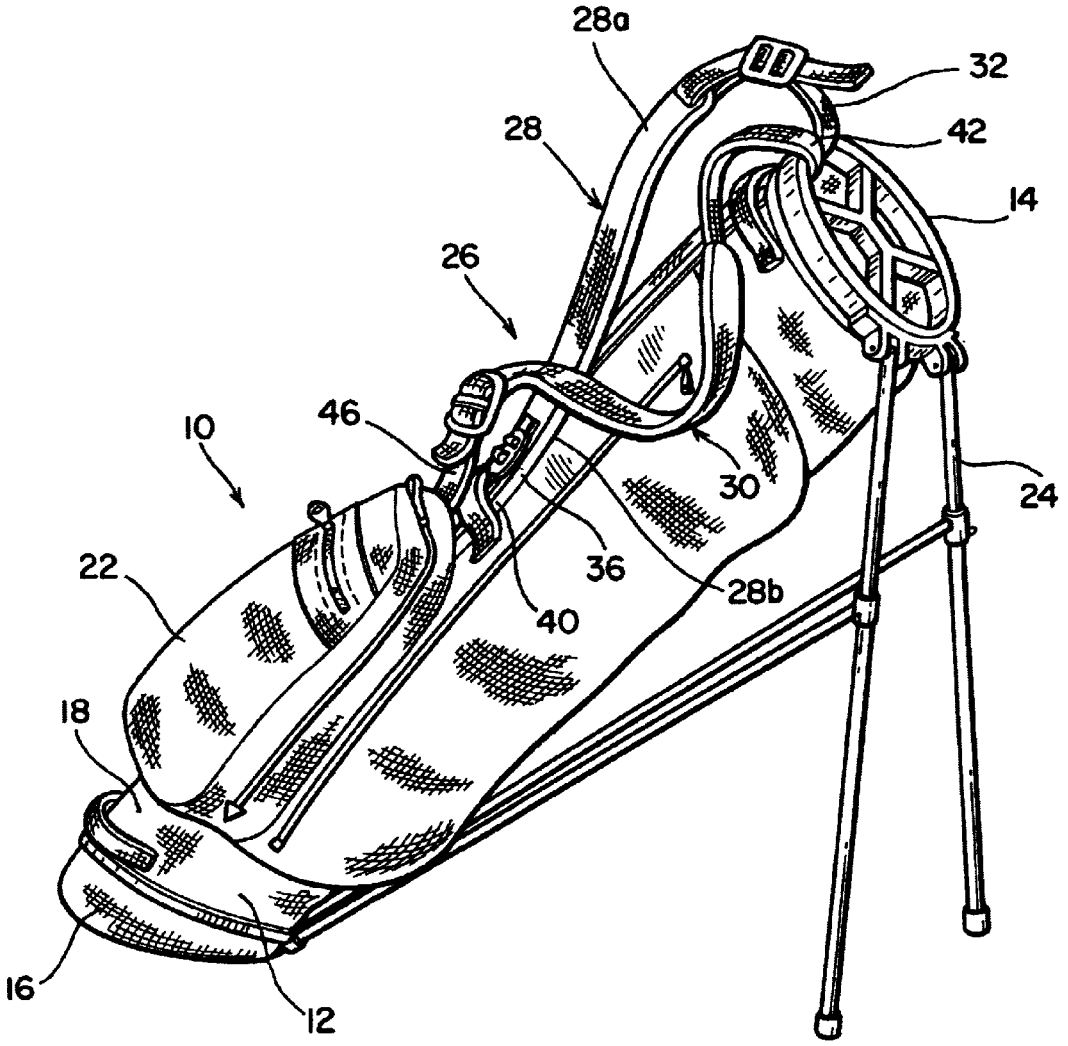
FIG. 1 is a perspective view of a golf bag having a shoulder strap assembly in accordance with the present invention.
Figure 2:
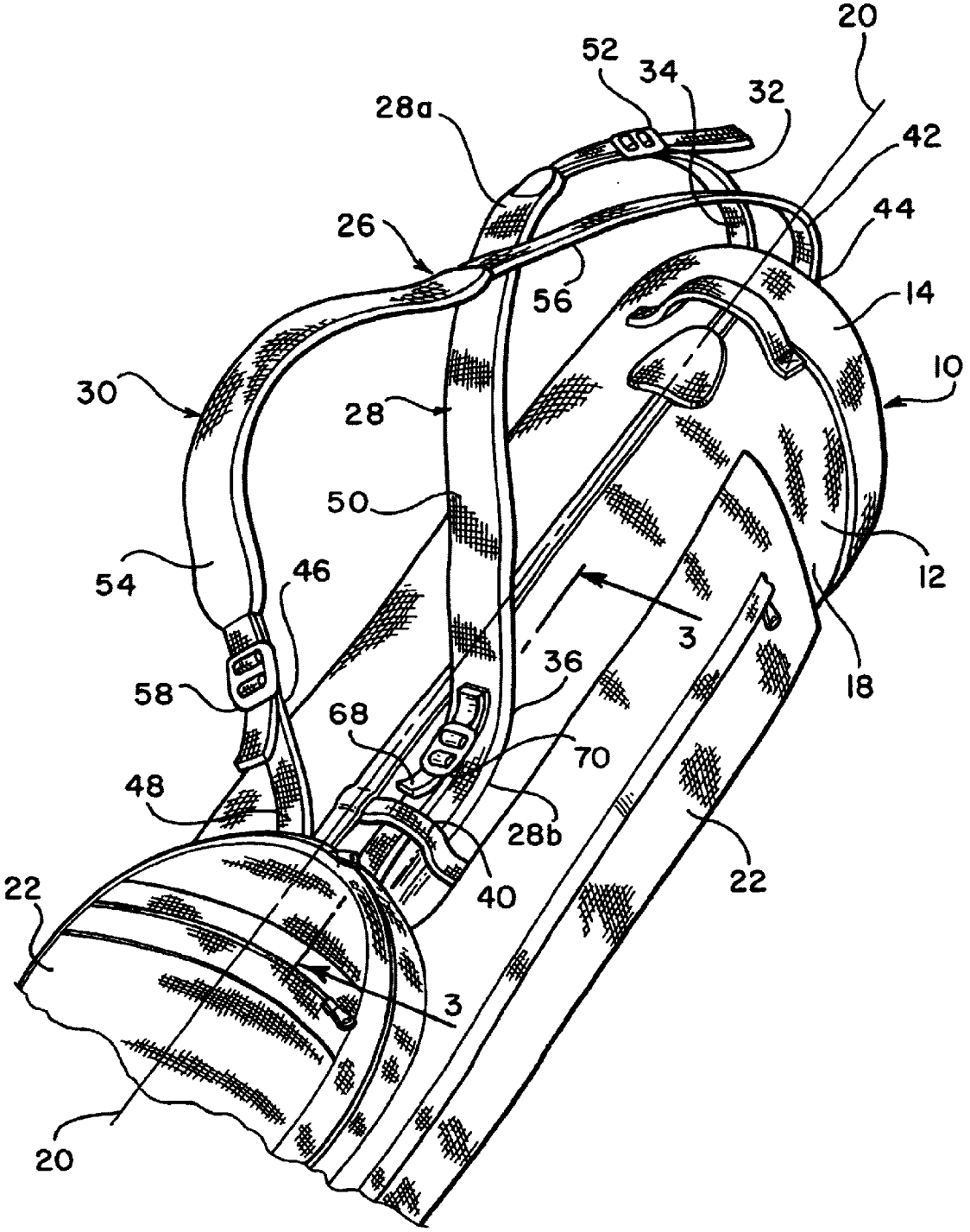
FIG. 2 is an enlarged fragmentary perspective view of the shoulder strap assembly shown in FIG. 1.

Referring to the drawings, FIG. 1 shows a golf bag which is indicated generally by the reference numeral 10. The golf bag 10 includes a body 12 of generally tubular configuration having top and bottom ends 14 and 16, respectively, which are attached such as by sewing to opposite ends of a fabric sleeve 18. The spacing between the top and bottom ends 14, 16 and the generally tubular configuration of the body 12 may be established and maintained by methods which are well known in the art. One method employs one or more elongated dowels (not shown) which are formed either of wood or fiber glass and extend between the molded top and bottom ends 14, 16 and are contained within channels sewn inside the fabric sleeve 18. Another method of forming the body 12 is to utilize an elongated tubular sleeve (not shown) formed of a synthetic resin which is positioned within the fabric sleeve 18 instead of the dowels. In either case, the body 12 has a spinal axis 20, which as seen in FIG. 2, extends longitudinally thereof.

The golf bag 10 may also include pockets 22 for carrying accessories used in playing golf such as golf balls, tees and the like, and an extensible stand 24 such as disclosed in U.S. Pat. No. 4,834,235 to John A. Solheim.

In accordance with the present invention, the golf bag 10 is provided with a dual shoulder strap assembly 26 having a first shoulder strap 28 and a second shoulder strap 30. The first shoulder strap 28 is especially configured so that an upper portion **28*a* thereof is held in a standing position wherein it extends generally laterally relative to the body 12 thereby making it easier for a golfer to identify which of the shoulder straps 28, 30 should be grasped first when preparing to lift the golf bag 10** and carry it.

The dual shoulder strap assembly 26 is preferably connected to the body 12 in a manner similar to that disclosed in U.S. Pat. No. 5,954,255 to Jay N. Beebe et al. Referring to FIG. 2, the first shoulder strap 28 has an upper end 32 attached to the body 12 at a first location 34 which is proximate the top end 14 thereof and is laterally off-set relative to the spinal axis 20 of the body 12. The first shoulder strap 28 has a lower end 36 which is coupled to the body 12 by cooperating interconnecting elements which will be described in detail below. Those cooperating interconnecting elements couple the lower end 36 of the first shoulder strap 28 to a second location 40 which is spaced from the body top end 14 and is intermediate the top and bottom ends 14, 16 of the body 12. The second location 40 is laterally off-set relative to the spinal axis 20 on the side thereof which is opposite the first location 34 so that the shoulder strap 28 crosses the spinal axis 20. The second shoulder strap 30 has an upper end 42 which is attached to the body 12 at a third location 44 which is proximate the top end 14 thereof and is laterally off-set relative to the spinal axis 20 of the body 12 on the side thereof which is opposite the first location 34. The shoulder strap 30 has a lower end 46 which is attached to the body 12 at a fourth location 48 which is spaced from the top end 14 and intermediate the top and bottom ends 14, 16 of the body 12. The fourth location 48 is laterally off-set relative to the spinal axis 20 on the side thereof which is opposite the second location 40 so that the second shoulder strap 30 crosses the spinal axis 20 in the same manner as the first shoulder strap 28 but in the opposite direction. Thus, the two shoulder straps 28, 30 will form an X-shaped pattern and cross each other in approximately the middle of the golfer's back when the golf bag 10 is being supported on the golfer's shoulders.

The first shoulder strap 28 includes an elongated pad 50 which is formed of foam rubber with a fabric cover, and the upper end 32 thereof may be coupled to the body 12 in a conventional manner such as by a webbing strip and a buckle 52. In addition to coupling the upper end 32 of the first shoulder strap 28 to the body 12, the webbing strip and the buckle 52 allow the overall length of the shoulder strap 28 to be adjusted to suit the particular preferences of the golfer.

Figure 4:
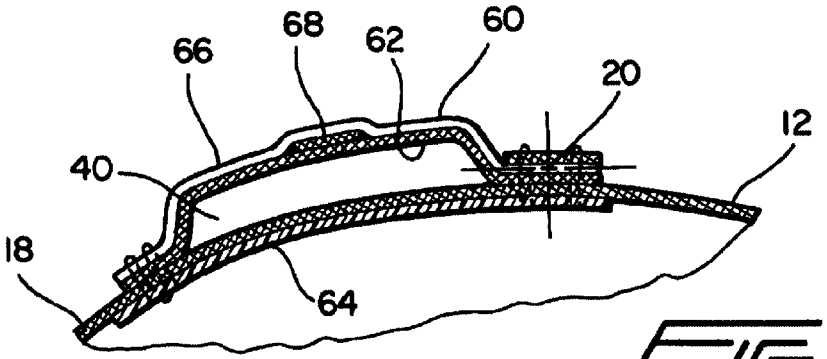
FIG. 4 is a sectional view taken along the lines 4—4 in FIG. 3.
Figure 3:
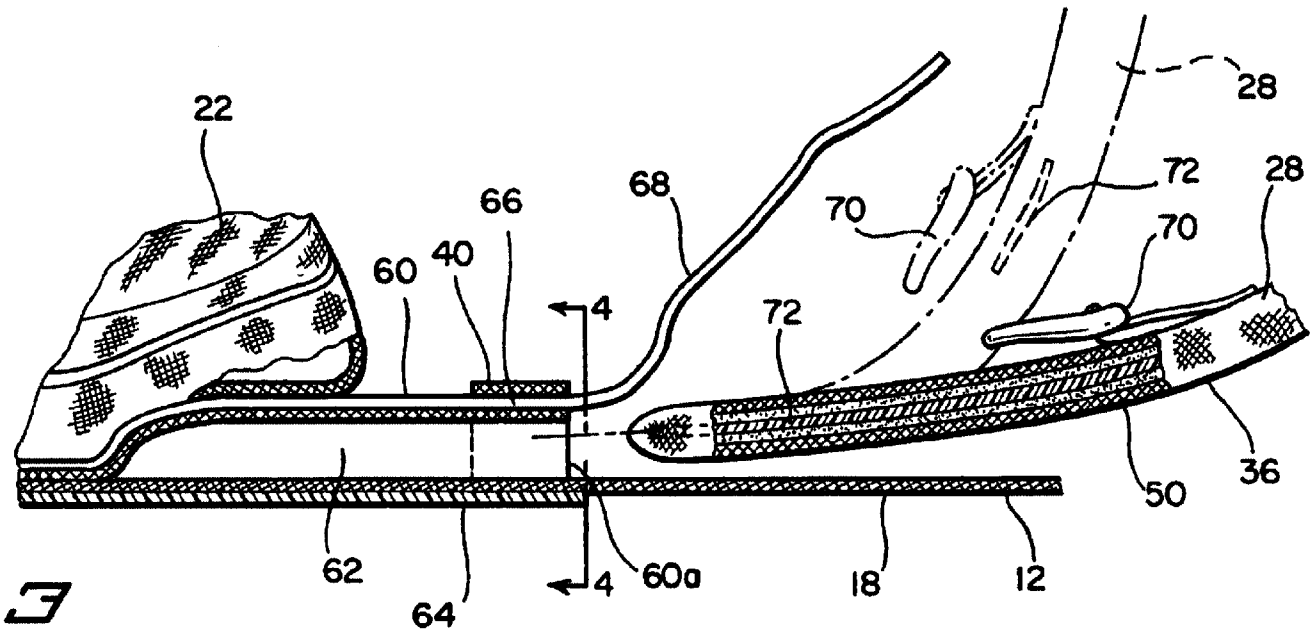
FIG. 3 is an enlarged sectional view taken along the lines 3—3 in FIG. 2.

The second shoulder strap 30 also includes an elongated pad 54, and the upper and lower ends 42, 46 thereof may be coupled to the body 12 in any suitable manner. The upper end 42 of the second shoulder strap 30 is shown as being coupled to the body 12 by a single webbing strip 56, and the lower end 46 thereof is seen as being coupled to the body 12 by means of a webbing strip and buckle assembly 58. Referring to FIGS. 3 and 4, the cooperating interconnecting elements that couple the lower end 36 of the first shoulder strap 28 to the body 12 at the second location 40 are shown. The lower end of 36 of the first shoulder strap 28 is removably received in a pocket 60 that is provided on the body 12 at the second location 40. The pocket 60 defines an elongated cavity 62 which opens toward the top end 14 of the body 12. When the tubular configuration of the body 12 is formed and maintained by one or more elongated dowels (not shown), the fabric sleeve 18 is reinforced in the area of the pocket 60 by a panel 64 which is attached such as by being sewn on the inner surface of the fabric sleeve 18. When the body 12 is formed by the method described above wherein an elongated tubular sleeve (not shown) is used instead of the dowels, the panel 64 will not be needed. The pocket 60 is attached to the plate 64, or to the elongated tubular sleeve (not shown) such as by sewing. In this manner, the cavity 62 in the pocket 60 will be held in a generally parallel relationship to the longitudinal dimension of the body 12 and the spinal axis 20 thereof. The opening 60*a* to the pocket 60 is reinforced by a suitable webbing strip 66 which overlays the opening 60*a* to prevent distortion of the opening 60*a*. The lower end 36 of the first shoulder strap 28 is received in the cavity 62 in the pocket 60 and may be slidably positioned therein so that the overall length of the first shoulder strap 28 may be adjusted. This length adjustment feature provided at the lower end 36 of the first shoulder strap 28 may be used independently or in conjunction with the length adjustment feature provided by the webbing and buckle 52 at the upper end 32 of the shoulder strap 28 or in place thereof. The lower end 36 of the shoulder strap 28 is retained in the pocket 60 by a webbing strip 68 which extends from the pocket 60 and is engaged by a buckle 70 provided on the lower end 36 thereof of the shoulder strap 28.

Stiffener means such as an elongated plate 72 is provided within the lower end 36 of the first shoulder strap 28. The plate 72 may be formed of a suitable synthetic resin or of a suitable metal, but in either case, it must be longitudinally flexible but laterally rigid, and it must be resilient enough so that it will return from a longitudinally flexed state to a linearly extending normal state. When the first shoulder strap 28 is in its relaxed state, that is the golf bag 10 is not being lifted or carried on the shoulders of a golfer, the plate 72 will be in its linearly extending normal state which holds a lower portion 28*b* of the shoulder strap 28 in a substantially juxtaposed position relative to the body 12. Since the overall length of the shoulder strap 28 is greater than the distance measured between the first and second locations 34, 40, the upper portion 28*a* of the shoulder strap 28 will be formed into a loop by the plate 72 and is then held by the plate 72 in a standing position where it extends generally laterally from the body 12. It will be understood that the golfer would not need to bend over to grasp the first shoulder strap 28 since the upper portion 28*a* thereof will extend to a height near the golfer's waist line.

Thus, the shoulder strap 28 is easily identified by the golfer who, after a very brief learning period, will instinctively grasp the shoulder strap 28 first when lifting the golf bag 10 into position on his or her shoulders. When the golf bag 10 is lifted and carried, the plate 72 will be moved from its linearly extending normal state into a longitudinally flexed state, as shown in dashed lines in FIG. 3, which provides the shoulder strap 28 with enough flexibility for comfortable positioning on the golfer's shoulders.

What is claimed is:

1. A golf bag including a body and a shoulder strap assembly comprising:

said body having a generally tubular configuration and a top end;

said shoulder strap assembly including a first shoulder strap having an upper end attached to said body at a first location proximate the top end thereof and a lower end;

cooperating interconnecting elements on said body and on the first shoulder strap for attaching the lower end of the first shoulder strap to said body at a second location which is spaced from the top end thereof, said cooperating interconnecting elements including a pocket on said body for receiving the lower end of said first shoulder strap and attachment means on said body and on the first shoulder strap for retaining the lower end of the first shoulder strap in said pocket, said attachment means including a webbing strip on said pocket and a buckle on the lower end of the first shoulder strap for engagement with said webbing strip; and stiffener means in the lower end of the first shoulder strap for holding an upper portion of the first shoulder strap in a standing position where it extends generally laterally from said body.

2. The golf bag of claim 1, further comprising:

said body having a spinal axis which extends longitudinally thereof; and said first location being laterally off-set on one side of the spinal axis, and said second location being laterally off-set on the opposite side of the spinal axis.

3. The golf bag of claim 2, further comprising:

said shoulder swap assembly including a second shoulder strap having upper and lower ends with the upper end thereof being attached to said body at a third location proximate the top end thereof and laterally off-set from the spinal axis of said body on the side thereof which is opposite the first location, the lower end of the second shoulder strap being attached to the body at a fourth location which is spaced from the top end of the body and laterally off-set from the spinal axis of said body on the side thereof which is opposite to the second location.

4. The golf bag of claim 1, wherein said stiffener means comprises an elongated plate mounted within the lower end of the first shoulder strap, said elongated plate being longitudinally flexible but laterally rigid.

5. The golf bag of claim 1, further comprising:

said first shoulder strap having an overall length which is greater than the distance measured between said first and second locations; and said stiffener means being an elongated plate which holds a lower portion of the first shoulder strap in a substantially juxtaposed position relative to said body, forms the upper portion of the first shoulder strap into a loop, and holds said loop in said standing position where it extends generally laterally from said body.

6. The golf bag of claim 5, wherein said elongated plate is longitudinally flexible and sufficiently resilient for movement between a linearly extending normal state when said body is at rest and a longitudinally flexed state when said golf bag is lifted by the first shoulder strap.

7. A golf bag including a body and a shoulder strap assembly comprising:

said body having a generally tubular configuration and a top end;

said shoulder strap assembly including a first shoulder strap having an upper end attached to said body at a first location proximate the top end thereof and a lower end;

a pocket on said body at a second location spaced from the top end of said body;

the lower end of the first shoulder strap being received in said pocket;

attachment means on said body and on the first shoulder strap for holding the lower end of the first shoulder strap in said pocket, said attachment means including a webbing strip on said pocket and a buckle on the lower end of the first shoulder strap for engagement with said webbing strip; and stiffener means in the lower end of the first shoulder strap for retaining an upper portion of the first shoulder strap in a standing position where it extends generally laterally from said body.

8. The golf bag of claim 7, wherein said first shoulder strap has an overall length and wherein said pocket defines an elongated cavity in which the lower end of the first shoulder strap is slidably positioned for adjusting the overall length of the first shoulder strap.

9. The golf bag of claim 8, wherein said stiffener means comprises an elongated plate which interacts with the elongated cavity in said pocket.

10. The golf bag of claim 7, wherein said pocket is reinforced by another webbing strip.

11. The golf bag of claim 7, further comprising:

said first shoulder strap having an overall length which is greater than the distance measured between said first and second locations; and said stiffener means being an elongated plate which holds a lower portion of the first shoulder strap in a substantially juxtaposed position relative to said body, forms the upper portion of the first shoulder strap into a loop, and holds said loop in said standing position where it extends generally laterally from said body.

12. The golf bag of claim 11, wherein said elongated plate is longitudinally flexible and sufficiently resilient for movement between a linearly extending normal state when said body is at rest and a longitudinally flexed state when said golf bag is lifted by the first shoulder strap.

13. A golf bag including a body and a shoulder strap assembly comprising:

said body having a generally tubular configuration and a top end;

said shoulder strap assembly including a first shoulder strap having an upper end attached to said body at a first location proximate the top end thereof and a lower end, said first shoulder strap having an overall length;

cooperating interconnecting elements on said body and on the first shoulder strap for attaching the lower end of the first shoulder strap to said body at a second location which is spaced from the top end thereof, said cooperating interconnecting elements including a pocket on said body for receiving the lower end of said first shoulder strap and attachment means on said body and on the first shoulder strap for retaining the lower end of the first shoulder strap in said pocket, said pocket defining an elongated cavity in which the lower end of the first shoulder strap is slidably positioned for adjusting the overall length of the first shoulder strap; and stiffener means in the lower end of the first shoulder strap for holding an upper portion of the first shoulder strap in a standing position where it extends generally laterally from said body.

14. The golf bag of claim 13, wherein said pocket is reinforced by another webbing strip.

15. The golf bag of claim 13, wherein said stiffener means comprises an elongated plate which interacts with the elongated cavity in said pocket.

* * * * *